United States Patent [19]

Baker

[11] Patent Number: 4,582,166

[45] Date of Patent: Apr. 15, 1986

[54] FIRE ESCAPE HAVING GUIDE WIRE MECHANISM

[75] Inventor: Ralph T. Baker, New Castle, Del.

[73] Assignee: Baker Safety Equipment, Inc., New Castle, Del.

[21] Appl. No.: 738,042

[22] Filed: May 24, 1985

[51] Int. Cl.[4] ..... A62B 1/20

[52] U.S. Cl. ..... 182/48; 193/25 R

[58] Field of Search ..... 182/48, 49, 10; 193/25 R

[56] References Cited

U.S. PATENT DOCUMENTS

| | | | |
|---|---|---|---|
| 2,779,596 | 1/1951 | Ridgway | 182/48 |
| 3,301,347 | 1/1967 | Saita | 182/48 |
| 3,580,358 | 5/1971 | Yamamoto | 182/48 |
| 3,826,335 | 7/1974 | Allen | 182/10 |
| 4,099,595 | 7/1978 | Tracy | 182/48 |
| 4,099,596 | 7/1978 | Tracy | 182/48 |
| 4,240,520 | 12/1980 | LaGrone | 182/47 |
| 4,339,019 | 7/1982 | Tracy | 182/48 |
| 4,398,621 | 8/1983 | Baker | 182/48 |

*Primary Examiner*—Reinaldo P. Machado
*Attorney, Agent, or Firm*—Mortenson & Uebler

[57] ABSTRACT

A fire escape means is provided comprising a moveable cart for storing and, when needed, moving a fire escape into position for deployment out of a building, the fire escape having an upper, supporting entry ring member and a mesh tube attached to this upper support member, the mesh tube being substantially longer than the building height from which escape is necessary, and a lower, exit-opening support ring member attached to the lower end of the mesh tube. During storage, the fire escape is folded into the cart. The building is provided with at least one opening through which the fire escape is to be deployed. To the building near this opening is permanently attached a guide wire which extends from the opening at a desired angle to the ground where it is permanently affixed to a rigid support on the ground. To the lower ring support member, one end of a leash means is attached, the leash means having a snap-on mechanism removeably engageable to the guide wire attached to the other end. When escape is necessary, the cart is moved to the opening, the lower support member is attached to the guide wire by means of the snap-on leash, the lower support member then slides down the guide wire and the fire escape tube is deployed. Preferably there is a latch mechanism affixed to the rigid ground support which is capable of receiving and latching the snap-on mechanism and affixing it to the ground support when the lower support member descends to the ground. Once deployed, the fire escape tube can be descended by a person or persons to escape a fire in said building.

16 Claims, 8 Drawing Figures

FIRE ESCAPE HAVING GUIDE WIRE MECHANISM

BACKGROUND OF THE INVENTION

This invention relates generally to fire escapes for an individual's use in evacuating a multiple story building.

Conventional fire escapes have disadvantages. They are generally finite in number, e.g. one or two per floor in a given building, if provided at all, and fixed in place so that, if smoke and flame approach a lower part of such fire escape, it is useless to persons on floors above the lower part.

As was apparent in the fires at the MGM Grand Hotel in 1980 and the Las Vegas Hilton hotel in 1981, present modern fire escapes are inadequate. In the MGM fire, at least 84 persons died. In the Hilton fire, 8 persons died. In both, helicopters having rescue seats suspended by cables from the aircraft were used to rescue persons from the roofs of the buildings and, in some instances, from balconies and windows. While these rescue efforts saved some lives, this method is very time consuming and terrifying to the inexperienced person being rescued.

More recently, 79 people died in a hospital fire in Bueno Aires, Argentina, because, as is typical in Argentina, the building was not equipped with fire escapes.

Many prior art devices are known which relate to chutes or tubes for use in escaping high-rise buildings in the event of a fire. Exemplary of such devices are those shown in U.S. Pat. No. 4,240,520 (1980) and U.S. Pat. No. 4,099,596 (1978).

U.S. Pat. No. 4,240,520 discloses a fire escape tunnel for use in exiting high-rise buildings. The tunnel includes an extendable, accordian-pleated tubing made of nylon or canvas fabric padded on its inner side, a ring at its upper end attachable to an escape opening of a building, a lower end of the tubing having a soft landing pad, and an exit doorway so a person sliding or being lowered down the tunnel can step out onto the ground at the exit.

U.S. Pat. No. 4,099,596 discloses a device including a normally-folded flexible tube with a landing pad at its lower end that unfolds to a vertical chute condition, the interior of the tube being slippery to provide against snagging and the like, the unfolded tube being formed with elastic restrictions at successive vertical levels that snub the descent of a person descending inside from free fall to an alleged safe speed.

U.S. Pat. No. 3,580,358 discloses a safety escape chute having a series of pliant tubular columns connected by resilient portions made of spiral mesh so that when a first escaper is in the chute his weight so deforms the spiral mesh resilient portions downwardly that a second escaper cannot pass therethrough and thus cannot collide with the first escaper at the bottom of the chute.

The fire escape tube utilized in this invention is basically as described and claimed in my prior U.S. Pat. No. 4,398,621, and that disclosure is incorporated herein by reference.

Escape tubes utilized in combination with an angularly disposed cable are known such as, for example, the apparatus disclosed in U.S. Pat. No. 4,339,019.

The present invention overcomes many disadvantages inherent in prior art devices.

SUMMARY OF THE INVENTION

Fire escape apparatus for exiting a building through an opening in the building is provided, the apparatus comprising an upper, supporting entry ring member and a mesh tube attached at its upper end to this upper supporting entry member, the mesh tube being substantially longer than the building height from which escape is necessary, and a lower, exit opening support ring member attached to the lower end of the mesh tube, this lower support ring member having a leash attached at one end thereto and having a snap-on hook affixed to the leash at its end opposite the end attached to the lower ring member, the building having permanently attached thereto, adjacent the opening, one end of a guide wire or cable extending from the building at a desired angle to the ground, the cable being permanently affixed at its other end to a ground anchor on the ground, whereby, when needed, a user snaps the snap-on hook onto the guide wire adjacent the building opening allowing the lower support ring and tube to deploy downwardly to the ground and providing the user means for escaping the building through the mesh tube. The upper and lower support rings and attached mesh tube and leash with snap-on hook are preferably contained in a moveable cart, and the upper support ring is preferably permanently attached to this moveable cart. The apparatus preferably has a cushioning pad affixed to the cart to cushion the exit of the user from the building opening. The apparatus preferably has a generally semi-circular spacer bar attached to the upper support ring and intertwined among the meshes of the mesh tube in such orientation that upon deployment of the tube the spacer bar is oriented at approximately 45° to the vertical, thereby providing an easily accessible entrance opening for the user. The ground anchor means preferably has affixed thereto, adjacent the cable connection, a spring loaded grasping latch means which grasps and holds the leash upon descent of the leash and lower support ring to the ground. The grasping latch means preferably has external grooves which can retain the leash in the event that the leash misses the grasping mechanism of the grasping latch upon deployment of the tube and support. The openings in the mesh tube are large enough to permit finger insertion therein but small enough to prevent foot insertion therethrough, and preferably have a maximum dimension of about two inches.

The mesh tube preferably has inside diameter sufficiently large so as not to restrict passage of a person escaping therethrough, so that an escaping person can control his rate of descent by grasping the mesh anywhere within the tube. The mesh tube preferably has an inside diameter in the range of about 3 feet to about 4 feet. The upper supporting entry member has a maximum outside dimension D and, when in use, the mesh tube extends through the opening of the building and downward to the ground, the opening having a maximum dimension d, wherein D is greater than d, the tube thereby being supported to permit a person to descend therethrough. The upper supporting entry member preferably is a metal ring having diameter D.

The apparatus preferably has an opaque shield encircling at least a part of the upper portion thereof so as to prevent a person using the escape from seeing through the mesh upon entry into the escape. The mesh tube is preferably made of fire resistant nylon cord or fire resistant, elastic bungi cord.

DETAILED DESCRIPTION OF THE INVENTION AND PREFERRED EMBODIMENTS WITH REFERENCE TO THE DRAWINGS

A fire escape means is provided comprising a moveable cart for storing and, when needed, moving a fire escape into position for deployment out of a building, the fire escape having an upper, supporting entry ring member and a mesh tube attached to this upper support member, the mesh tube being substantially longer than the building height from which escape is necessary, and a lower, exit-opening support ring member attached to the lower end of the mesh tube. During storage, the fire escape is folded into the cart. The building is provided with at least one opening through which the fire escape is to be deployed. To the building near this opening is permanently attached a guide wire which extends from the opening at a desired angle to the ground where it is permanently affixed to a rigid support on the ground. To the lower ring support member, one end of a leash means is attached, the leash means having a snap-on mechanism removeably engageable to the guide wire attached to the other end. When escape is necessary, the cart is moved to the opening, the lower support member is attached to the guide wire by means of the snap-on leash, the lower support member then slides down the guide wire and the fire escape tube is deployed. Preferably there is a latch mechanism affixed to the rigid ground support which is capable of receiving and latching the snap-on mechanism and affixing it to the ground support when the lower support member descends to the ground. Once deployed, the fire escape tube can be descended by a person or persons to escape a fire in said building.

Figure 1:
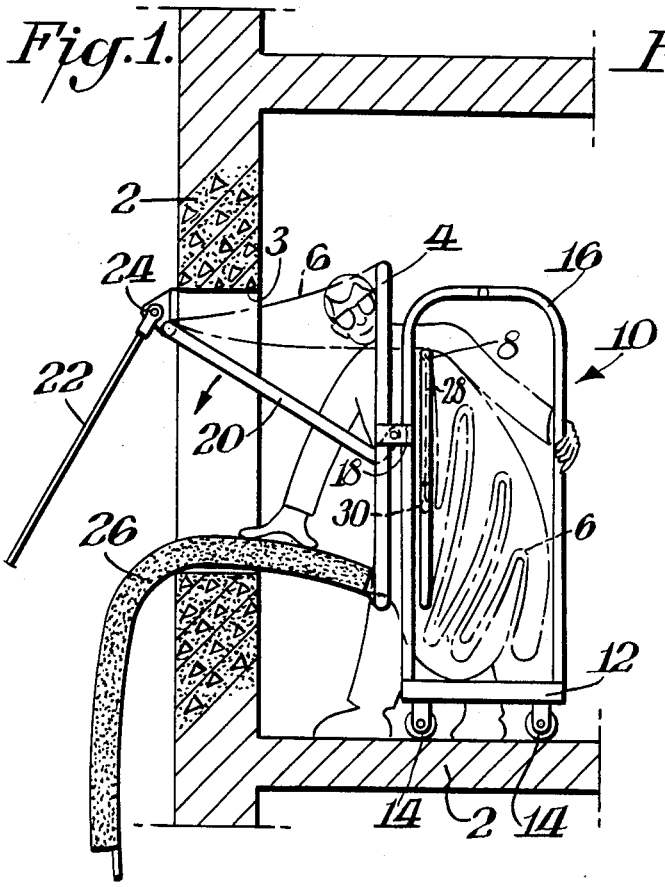
FIG. 1 is a side elevational view of the upper portion of the apparatus according to this invention showing the user beginning to deploy the fire escape.

A detailed description of the invention and preferred embodiments is best provided with reference to the accompanying drawings wherein FIG. 1 shows the components of the upper portion of the apparatus according to the invention located in and on the building 2 having window-like opening 3. The components of the apparatus shown include the upper, larger entry support ring 4, preferably affixed by attachment means 18 to the frame 16 mounted on a moveable cart 12 having wheels 14. Prior to use, this apparatus can be stored in a closet for convenience. Attached to upper ring 4 is mesh tube 6, the details of which are not shown for clarity, attached at its other end to lower support ring 8. The lower ring has lanyard or leash 28 attached thereto as shown having a snap-on hook means 30 attached to its other end. Cushion 26 is preferably affixed to upper support ring 4 to help prevent scrapes and injuries to persons escaping as a result of hitting the building 2. The mesh tube 6 has semi-circular spacer bar 20 woven through it at the longitudinal distance downwardly of said tube from said upper support ring such that, in use as shown, the spacer bar 20 pivots to an approximately 45° angle to the vertical formed with upper support ring 4 to provide a convenient, held-open entrance for users. The attachment means 18 includes means for pivotally attaching the semi-circular spacer bar 20 to upper support ring 4. Guide wire or cable 22 is shown attached to the building 2 adjacent the opening 3 by permanent attachment means 24.

As depicted in FIG. 1, the user has wheeled the cart 12 containing the fire escape chute apparatus to a position in front of a building opening 3 and has set the cushion 26 in place and pivoted the spacer bar 20 into position as indicated by the arrow.

Figure 2:
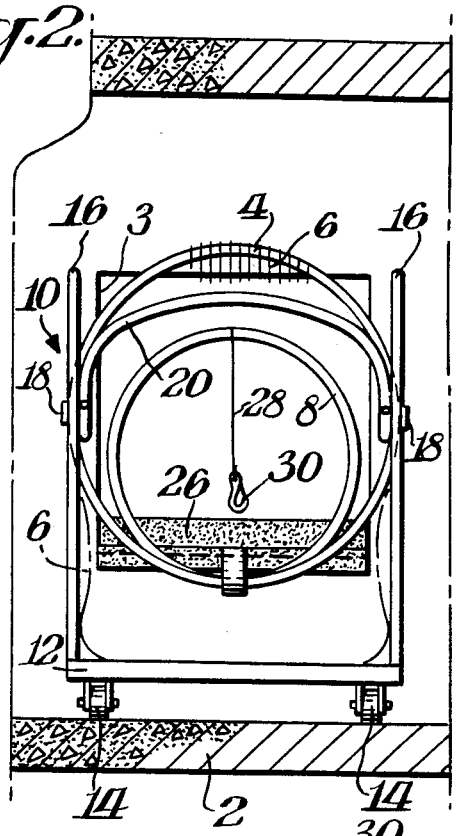
FIG. 2 is a rear elevation of the moveable cart means on which is stored the upper support ring and lower support ring attached to the mesh tube according to the invention, including the semi-circular spacer bar which maintains the entrance open. Details of the mesh tube have been omitted from this figure for convenience.

FIG. 2 shows a rear elevation of cart 12 and support rings 4 and 8 and semi-circular spacer bar 20. Ring 4 and spacer bar 20 are affixed to frame 16 by means 18. Also shown are cushion 26 and leash 28 having attached snap-on hook 30 attached to ring 8 as shown. Details of netting 6 are omitted for clarity of presentation.

Figure 3:
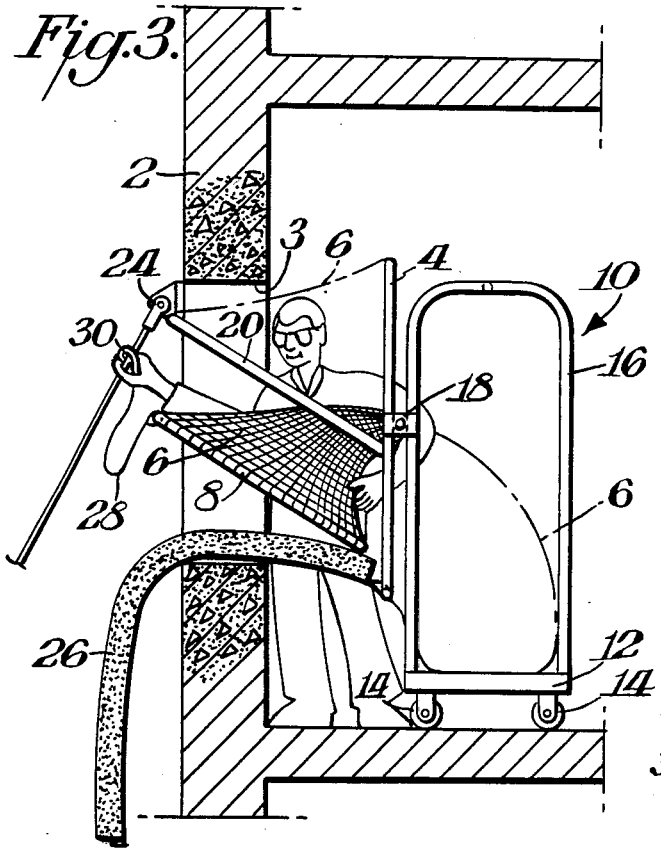
FIG. 3 is an elevational view showing the user snapping the snap-on hook onto the guide wire prior to deployment of the fire escape chute.
Figure 4:
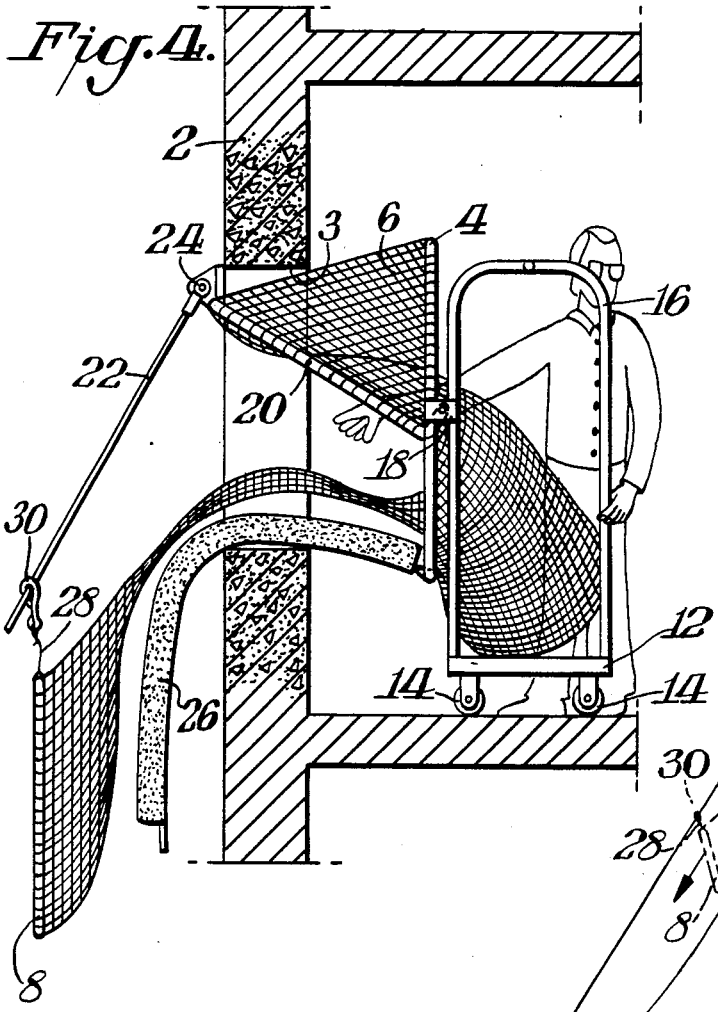
FIGS. 4 and 5 show sequentially the full deployment of the fire escape chute according to the invention.
Figure 5:
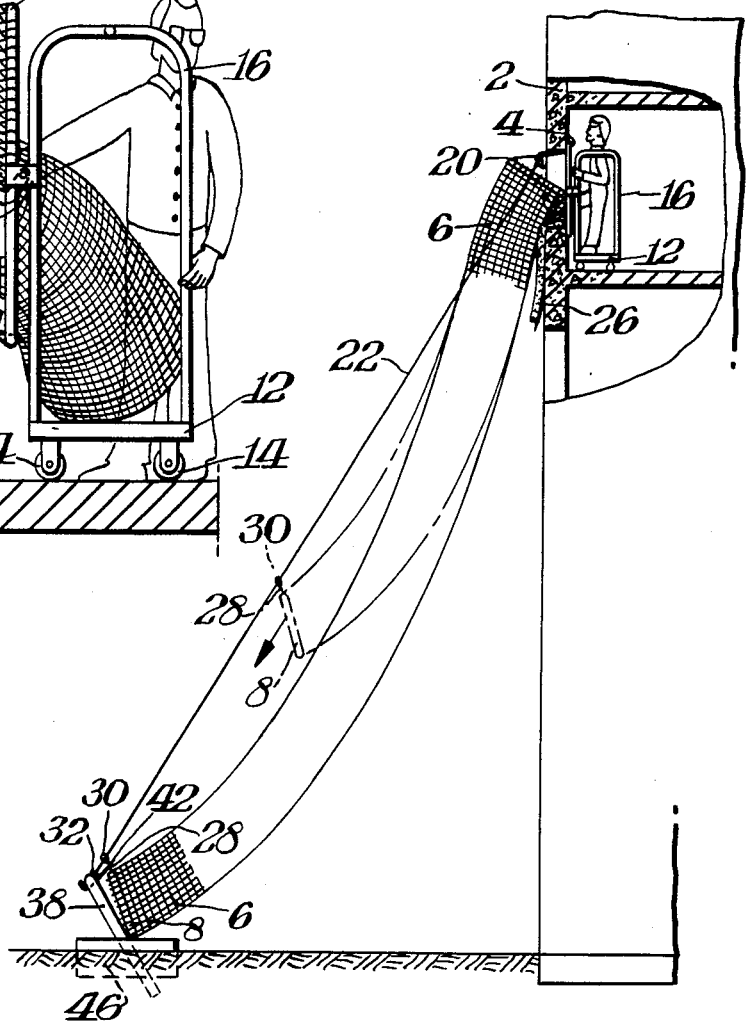

FIGS. 3–5 show the sequence of steps in deployment of the apparatus according to the invention. In FIG. 3, the user is shown drawing the smaller, lower support ring 8 through the larger upper support ring 4 and under spacer bar 20. Snap-on hook 30, similar to the hook commonly found on pet leashes, is snapped onto cable 22 and is thereby firmly attached thereto. Deployment of the chute is now ready to proceed.

FIG. 4 shows the initial stage of descent of lower support ring member 8 and mesh tube 6. The ring 8 slides down guide wire 22, held by means of snap-on ring 30, under the influence of gravity. As it descends, more and more of mesh tube 6 is payed out from its folded condition in cart 12.

FIG. 5 shows an overall elevation, partly broken away, of the fire escape apparatus of the invention in a partly deployed condition (phantom) and fully deployed with lower support ring 8 anchored to the ground. In the intermediate stage of descent, the lower support ring 8 and attached mesh tube 6 are descending rapidly as indicated by the arrow shown. In the fully deployed stage, the mesh tube 6 extends from opening 3, held there by upper support ring 4, downwardly as shown to the ground, being anchored there by means of ground anchor 32 which holds spring-loaded grasping latch means 42 which has received leash 28 and holds it fixedly in place. In such a fully deployed state, users can now safely descend from the building 2 to the ground in the event of a fire.

Figure 6:
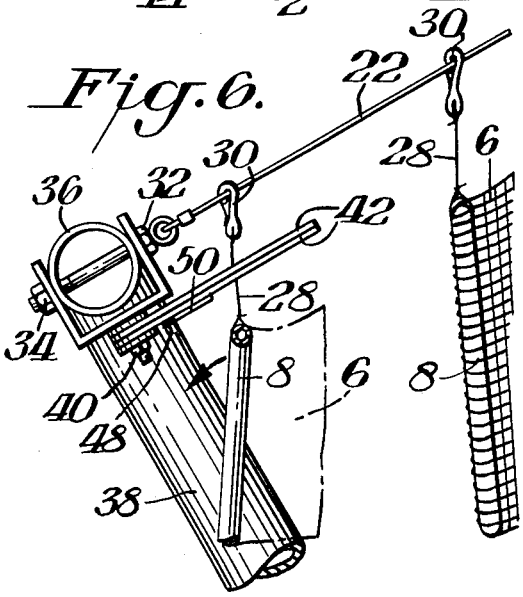
FIG. 6 is a side elevation, partly in cross-section, showing ground anchoring latch means and spring-loaded grasping latch means for catching and retaining the lower support means upon deployment of the fire escape chute.

FIG. 6 shows a side elevation of a portion of the ground anchoring means showing guide wire 22 affixed to ground anchor cross member 36 by means of bolt and eye 32 secured by nut 34 which permanently anchor cable 22. Spring-loaded grasping latch means 42 is shown affixed to ground anchor cross member 36 by means of bolt 40. The descending fire escape chute is shown approaching and then being grasped and retained by spring-loaded latch means 42 (in phantom).

Figure 7:
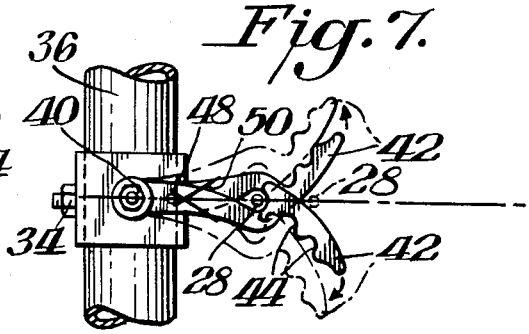
FIG. 7 is a bottom plan view of the spring-loaded grasping latch means for catching and retaining the lower support means.

FIG. 7 shows a bottom plan view of the spring-loaded latch means having fingers, both denoted 42, spring-biased to the closed position by spring 50 held by pin 48. As the leash 28 approaches the latch means, the fingers are spread apart as the leash enters the "V" formed by fingers 42 to accept the leash 28, after which the fingers 42 are closed by the spring bias 50 and they retain the leash 28 and the bottom support member 8 securely at ground level. If for some reason the leash 28 misses the "V" opening between fingers 42, e.g. due to wind, then external grooves 44 may cath the leash 28 and hold it at ground level.

Figure 8:
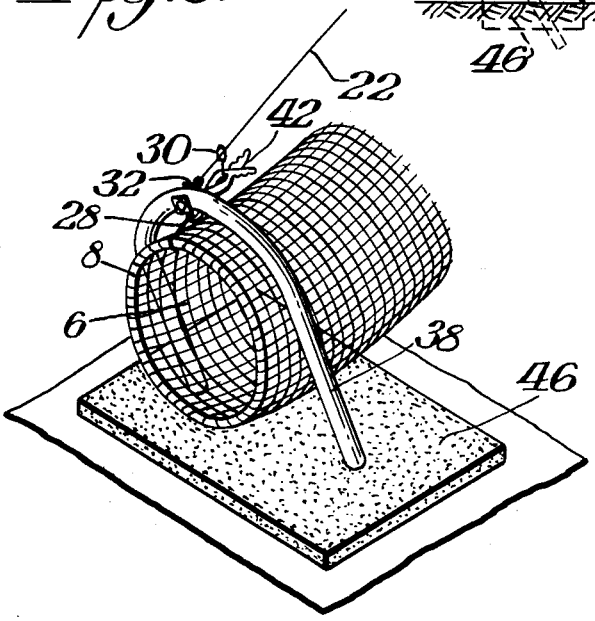
FIG. 8 is a pictorial view of the ground anchor means from which a person exits the fire escape chute of the invention.

FIG. 8 shows a pictorial view of the lower end of the apparatus of the invention showing ground anchor bar 38 firmly and permanently mounted in foundation 46. Exit-opening support ring 8 is attached to the ground anchor by means of spring-loaded latch means grasping leash 28.

Suitable materials of construction for the various components of the invention will be apparent to one skilled in the art. The various support and frame members for example can be made from structurally sound aluminum or steel tubing. The mesh netting is preferably made of fire resistant nylon cord or fire resistant elastic bungi cord.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Fire escape apparatus for exiting a building through an opening in said building, the apparatus comprising an upper, supporting entry ring member and a mesh tube attached at its upper end to said upper supporting entry member, said mesh tube being substantially longer than the building height from which escape is necessary, and a lower, exit opening support ring members attached to the lower end of said mesh tube, said lower support ring member having a leash attached at one end thereto and having a snap-on hook affixed to said leash at its end opposite the end attached to said lower ring member, said building having permanently attached thereto adjacent said opening one end of a guide wire or cable extending from said building at a desired angle to the ground, said cable being permanently affixed at its other end to a ground anchor on the ground, whereby, when needed, a user snaps said snap-on hook onto said guide wire adjacent said building opening allowing said lower support ring and tube to deploy downwardly to the ground and providing said user means for escaping said building through said mesh tube.

2. The apparatus of claim 1 wherein said upper and lower support rings and attached mesh tube and leash with snap-on hook are contained in a moveable cart.

3. The apparatus of claim 2 wherein said upper support ring is permanently attached to said moveable cart.

4. The apparatus of claim 2 having a cushioning pad affixed to said cart to cushion the exit of said user from said building opening.

5. The apparatus of claim 1 having a generally semicircular spacer bar attached to said upper support ring and intertwined among the meshes of said mesh tube in such orientation that upon deployment of said tube said spacer bar is oriented at approximately 45° to the vertical, thereby providing an easily accessible entrance opening for said user.

6. The apparatus of claim 1 wherein said ground anchor means has affixed thereto adjacent said cable connection a spring loaded grasping latch means which grasps and holds said leash upon descent of said leash and lower support ring to the ground.

7. The apparatus of claim 6 wherein said grasping latch means has external grooves which can retain said leash in the event that said leash misses the grasping mechanism of said grasping latch upon deployment of said tube and support.

8. The apparatus of claim 1 wherein the openings in said mesh tube are large enough to permit finger insertion therein but small enough to prevent foot insertion therethrough.

9. The apparatus of claim 1 wherein the openings in said mesh tube have a maximum dimension of about two inches.

10. The apparatus of claim 1 wherein said tube has inside diameter sufficiently large so as not to restrict passage of a person escaping therethrough, whereby said escaping person can control his rate of descent by grasping the mesh anywhere within the tube.

11. The apparatus of claim 1 wherein said mesh tube has an inside diameter in the range of about 3 feet to about 4 feet.

12. The apparatus of claim 1 wherein said upper supporting entry member has a maximum outside dimension D and said mesh tube extends through said opening of said building and downward to the ground, said opening having a maximum dimension d, wherein D is greater than d, the tube thereby being supported to permit a person to descend therethrough.

13. The apparatus of claim 12 wherein said upper supporting entry member is a metal ring having diameter D.

14. The apparatus of claim 1 having an opaque shield encircling at least a part of the upper portion thereof so as to prevent a person using the escape from seeing through said mesh upon entry into the escape.

15. The apparatus of claim 1 wherein said mesh tube is made of fire resistant nylon cord.

16. The apparatus of claim 1 wherein said mesh tube is made of fire resistant, elastic bungi cord.

* * * * *